US005994987A

United States Patent [19]

Passow

[11] Patent Number: 5,994,987

[45] Date of Patent: Nov. 30, 1999

[54] CONTACT MECHANISM FOR ELECTRONIC OVERLOAD RELAYS

[75] Inventor: Christian Henry Passow, Batavia, Ill.

[73] Assignee: Siemens Energy & Automation, Inc., Alpharetta, Ga.

[21] Appl. No.: 09/079,710

[22] Filed: May 15, 1998

[51] Int. Cl.[6] ..... H01H 51/22

[52] U.S. Cl. ..... 335/78; 335/128; 335/124

[58] Field of Search ..... 335/78–90, 115–117, 335/113, 124, 126, 127, 128–131

[56] References Cited

U.S. PATENT DOCUMENTS 3,925,742 12/1975 Muench ..... 335/186
4,181,907 1/1980 Esposito et al. ..... 335/170

*Primary Examiner*—Lincoln Donovan

[57] ABSTRACT

An improved trip mechanism for an overload relay includes a housing, a bistable armature mounted in the housing on a pivot for pivotal movement between two stable positions and fixed contacts within the housing. Moveable contacts are located within the housing and springs engage the moveable contacts and urge the same toward the fixed contacts to establish an electrical conducting relationship therebetween. Moveable, contact engaging posts are located on the armature and opposite of the springs for engaging the moveable contacts and moving them away from the fixed contacts against the bias of the springs for one of the two stable positions and for effectively disengaging the moveable contacts to allow the springs to move the moveable contacts into the electrical conducting relation. The relay further includes a latch surface carried by the housing and a spring mounted on the housing and having a latch finger for engaging the latch surface and retaining the armature in one of its two positions.

16 Claims, 2 Drawing Sheets

CONTACT MECHANISM FOR ELECTRONIC OVERLOAD RELAYS

FIELD OF THE INVENTION

This invention relates to electrical relays, and more particularly, to a trip mechanism for an overload relay.

BACKGROUND OF THE INVENTION

Overload relays are electrical switches typically employed in industrial settings to protect electrical equipment from damage due to overheating in turn caused by excessive current flow. In a typical case, the electrical equipment is a three-phase motor which is connected to a power source through another relay commonly referred to as a contactor. A typical contactor is a heavy duty relay having three switched power paths for making and breaking each of the circuits connected to the three phase power source. The motion required to make and break the contacts is provided magnetically as a result of current flow through a coil which in turn is energized by a current whose flow is controlled by another switch, typically remotely located.

In a conventional setup, an overload relay is connected in series with the control switch for the coil of the contactor. When an overload condition is detected by the overload relay, the same cuts off power to the coil of the contactor, allowing the contactor to open and disconnect the electrical equipment that is controlled by the contactor from the source of power to prevent injury to the electrical equipment.

In the past, overload relays have utilized resistive heaters for each phase which are in heat transfer relation with a bimetallic element which in turn controls a switch. When an overload is sensed as, for example, when there is sufficient heat input from the resistive heater to the bi-metallic element, the bimetallic element opens its associated switch to de-energize the contactor coil and disconnect the associated piece of electrical equipment from the source of power.

More recently, the resistive heater-bi-metallic element type of relay has been supplanted by electronic overload relays. See, for example, commonly assigned U.S. Pat. No. 5,179,495 issued Jan. 12, 1993, to Zuzuly, the entire disclosure of which is herein incorporated by reference. Outputs of such circuitry typically are relatively low powered and as a consequence, in order for the output to control the contactor coil current, a solid state switch may be required. The solid state switch may, in turn, control flow to a relatively low power contact mechanism which in turn is operable to control the flow of current to the contactor as well as to operate an indicator. In the usual case, the indicator will be a light which will be illuminated upon the occurrence of a disconnect resulting from an overload. One such contact mechanism is disclosed in my commonly assigned co-pending application entitled, "Trip Mechanism for an Overload Relay", Serial No. 08/838,904, Filed Apr. 11, 1997, the entire disclosure of which is herein incorporated by reference.

The trip mechanism therein disclosed uses so-called "bridging" contacts which is to say, an elongated contact bar is brought into contact with two spaced, fixed contacts as a result of movement of the armature. The contact bar is biased against a cross member on a post carried by the armature and which provides a fulcrum for the contact bar. Because the armature pivots, the contact bars are moved in an arcuate path as the armature shifts between two bistable positions and, of course, the contact bar may pivot somewhat on the fulcrum as well. Consequently, there is the possibility that one end of the contact bar will contact one of the fixed contacts before the other end of the contact bar contacts its associated fixed contact. Desirably, however, the contact bar should contact both fixed contacts simultaneously.

Additionally, there is concern for environmental grime being deposited on the contact surfaces of one or more of the contacts. Particularly when the electric circuit being made or broken by the contacts is of a relatively low power, such grime can interfere with the generation of a clean signal upon the closing of the contacts. Thus, the trip mechanism of my co-pending application provides for a measure of wiping of the fixed contacts by the moveable contacts when they closed to avoid the effects of such environmental grime. At the same time, it is desirable to provide substantial wiping wherein the wiping movement of the moveable contacts on the fixed contacts is a positively driven movement to assure that the desired wiping action will take place.

The present invention is directed to overcoming one or more of the above.

SUMMARY OF THE INVENTION

It is the principal object of the invention to provide a new and improved trip mechanism for an overload relay. It is also an object of the invention to provide a switch with an improved, positive wiping action.

An exemplary embodiment of the invention, according to one aspect thereof, achieves the foregoing objects in a trip mechanism for an overload relay comprising a housing, a bistable armature mounted in the housing on a pivot for pivotal movement between two stable positions, and fixed contacts within the housing. The invention contemplates the provision of moveable contacts within the housing along with spring means within the housing engaging the moveable contacts and normally urging the moveable contacts toward the fixed contacts to establish an electrical conducting relation therebetween. Moveable contact engaging means are disposed on the armature and located oppositely of the spring means for engaging the moveable contacts and moving them away from the fixed contacts against the bias of the spring means for one of the two stable positions and for effectively disengaging the moveable contacts to allow the spring means to move the moveable contacts into the electrical conducting relation for the other of the two stable positions. A latch surface is carried by one of the armature and the housing and a spring is mounted on the other of the armature and the housing. The spring has a latch finger for engaging the latch surface and retaining the armature in one of the two positions.

In a preferred embodiment, the latch surface is provided on a latch arm carried by the armature. The invention also contemplates the provision for means for disabling the latch arm.

Preferably, the disabling means comprises a manual operator. In a preferred embodiment, the manual operator is a push button reciprocally mounted on the housing for movement toward and away from the latch arm.

In a preferred embodiment, the armature is elongated and the moveable contact engaging means includes an elongated contact engaging post extending generally transverse to the direction of elongation of the armature. The moveable contacts include an elongated contact bar generally parallel to the armature and a fulcrum is located on the post together with a biasing spring carried by the housing for biasing the contact bar into engagement with the fulcrum. In a highly preferred embodiment, the fulcrum is defined by two spaced surfaces on the post that are located such that they cause the contact bar to be brought simultaneously into contact with both of the fixed contacts.

According to another facet of the invention, there is provided a switch for use in an electrical mechanism which includes an actuator mounted on a pivot for movement between two actuator positions. A pair of spaced, fixed contacts are provided along with a contact bar moveable between a closed position engaging and bridging the fixed contacts to electrically connect the same and an open position spaced from the fixed contacts. A contact carrier is located on the actuator to be moveable therewith and has a contact mounting post with a side-to-side first predetermined dimension measured in a plane spaced from the pivot. A slot is located in the contact bar for freely receiving the post to allow movement of the contact bar on the post in the transverse direction. The slot has an end-to-end, second predetermined dimension in the transverse direction greater than the first dimension. The post carries the contact bar such that it will move to the closed bridging position at an intermediate actuator position as the actuator moves from one of the two actuator positions and before the actuator reaches the other of the two actuator positions. The first and second dimensions are such that the post will engage an end of the slot at or after the actuator reaches the intermediate position and before the actuator reaches the other actuator position. Consequently, when the actuator moves from the one actuator position, the contact bar will move to the closed position and the post will then or thereafter engage the end of the slot to shift the contact bar relative to the fixed contacts while engaged therewith as the actuator continues to move from the intermediate actuator position to the other actuator position.

In a preferred embodiment, the contact bar is elongated in the transverse direction.

Preferably, the first and second dimensions are elongated in the transverse direction.

In a preferred embodiment, the post includes a shoulder and the contact bar is moveable on the post toward and away from the shoulder. A spring is provided to bias the contact bar toward the shoulder.

Additional objects and advantages of the invention will be set forth in the description which follows and in part will be obvious from the description, or may be learned by practice of the invention. The objects and advantages of the invention may be realized and obtained by means of the instrumentalities and combinations particularly pointed out in the appended claims.

DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

DESCRIPTION OF THE PREFERRED EMBODIMENT

Figure 1:
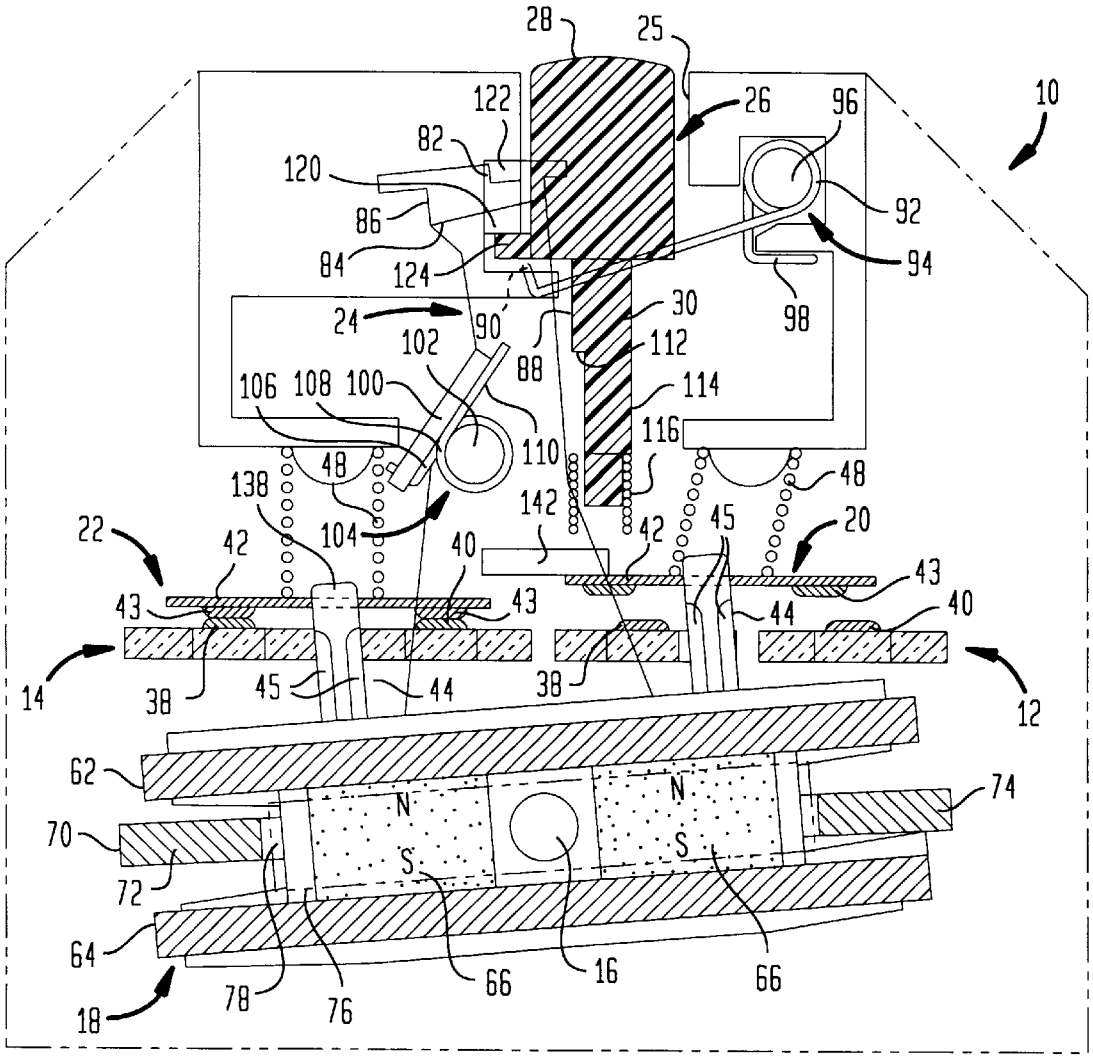
FIG. 1 is a somewhat schematic view of a trip mechanism for an overload relay made according to the invention.

Referring to the drawings, the overload relay is shown in a reset position, specifically, an auto-reset position, and includes a housing, generally designated 10, which is shown somewhat schematically. Mounted within the housing 10 is a set of normally open fixed contacts, generally designated 12, and a set of normally closed, fixed contacts, generally designated 14. The housing includes a pivot pin 16 upon which an elongated, bistable armature, generally designated 18 is pivoted for movement between two stable positions. The armature 18 is shown in one of its stable positions and is operative to maintain a first set of moveable contacts, generally designated 20, in an open position. In its other bistable position, the armature 18 is operative to hold open a second set of moveable contacts, generally designated 22, which are normally closed. The contacts 20 and 22 make and break with the fixed contacts 12 and 14 respectively.

A latch lever, generally designated 24, is connected to the armature 18 to be moveable therewith and thus will rock about the pivot 16 between the two stable positions of the armature 18. The housing includes an opening 25 which reciprocally receives a manual operator, generally designated 26, which includes a push button surface 28 and a depending shank 30. The push button 28 is mounted for movement generally toward and away from the latch lever 24.

Figure 2:
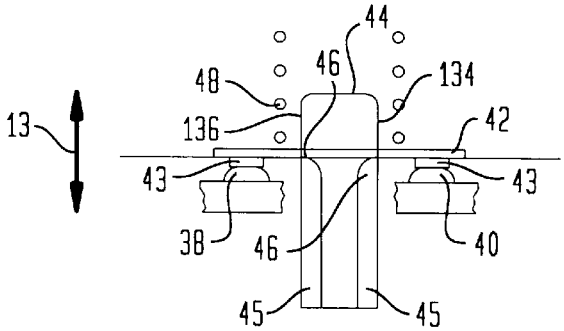
FIG. 2 is a fragmentary view of a preferred form of contact construction for use in the invention.
Figure 3:
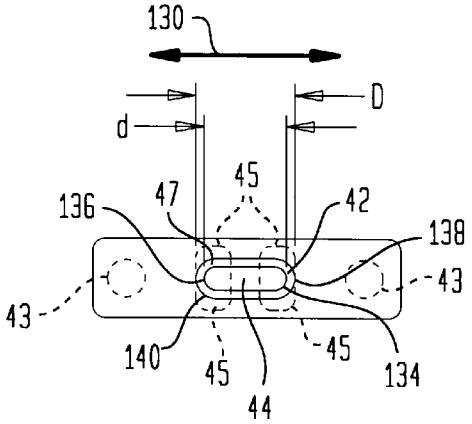
FIG. 3 is a plan view of the contact construction.

Turning to the fixed contacts 12,14, the same each include two electrically and physically spaced contacts 38 and 40. The contacts 38 and 40 comprising each set of fixed contacts 38,40 are each adapted to be bridged by a respective elongated contact bar 42 carrying spaced contacts 43. Each contact bar 42 is elongated in the same direction as the armature 18 and is loosely mounted at its midpoint on a respective post 44 that extends from the armature 18 in a direction generally transverse to its direction of elongation. The two posts are located to respective sides of the pivot 16. As best seen in FIGS. 2 and 3, each post 44 includes two spaced, laterally directed ribs 45 on each of its two sides. The upper ends of the ribs 45 define two spaced shoulder surfaces 46. Each contact bar 42 includes a generally centrally located elongated notch or slot 47. The slot 47 is elongated in the same direction as the armature 18 and allows each contact bar 42 to be loosely impaled on the upper end of its associated post 44. Springs 48 are operative to bias the contact bars 42 toward the shoulder surfaces 46. The relative heights of the shoulders 45 are such that they terminate in a plane "P" (FIG. 2) that is defined by the upper surfaces of the contacts 38,40 when the contact bar contacts 43 first make contact with the contacts 38,40, assuring that both are contacted simultaneously. The posts 44 are located on the sides of the contact bars 42 opposite the springs 48.

Turning now to the armature 18, the same includes a first magnetic pole piece 62 and a parallel, spaced, second magnetic pole piece 64. The pole pieces 62 and 64 sandwich the pivot 16 as well as two permanent magnets 66. The permanent magnets 66 could be a unitary structure but for convenience, and to accommodate the pivot 16, they are shown as two separate magnets.

The housing 10 mounts a magnetic yoke or pole piece 70 which is the form of a shallow "U" having legs 72 and 74. An electrical coil 76 is disposed about the bight 78 of the pole piece 70. In some cases, the electrical winding 76 will be a single coil while in other cases, two electrically separate coils will be wound thereon, one on top of the other. The particular arrangement depends upon the control mode of the electric circuitry employed with the mechanism. If the same reverses current flow through the coil 76 to switch the relay from one state to another, only a single coil need be used. On the other hand, if the electronic circuitry does not reverse current flow, then two coils, oppositely wound from one another, would be employed as a coil 76 with the electronic circuitry powering one coil or the other to switch the relay from one state to another.

Turning now to the latch lever 24, the same is moveable from the position shown in FIG. 1 through a plurality of intermediate positions to another stable position whereat the pole piece 64 stops and substantially abuts against the underside of the leg 72 of the pole piece 70. At its upper end, the latch lever includes an elongated notch 82 which underlies an opening (not shown) in the housing 10. A tool, such as the tip of a screwdriver, can be fitted through the opening and inserted into the notch 82 to apply a manual force to the lever 24 to shift it between the two stable positions of the armature 18 for manual test purposes.

Just below the notch 82, a latch surface defined by two adjoining surfaces 84,86 is provided. Underlying the latch surface 84,86 is a spring latching finger 88 having an upturned end 90 that is adapted to embrace and latch against the surface 86 of the latch surface 84,86 under certain conditions to be described. The latch finger 88 extends from the coil 92 of a torsion spring, generally designated 94, which is mounted on a post 96 within a pocket within the housing 10. Alternatively, the spring 94 may be mounted on the latch lever 24 and the latch surface 84,86 located on the housing 10.

The end 98 of the coil 92 opposite the latch finger 88 is abutted against the housing 10 to prevent rotation of the coil 92 on the post 96. The latch finger may latch the latch lever 24 in one of the two stable positions of the armature 18, namely, that shifted from the position shown in FIG. 1 to a position whereat the pole piece 64 is in contact with the underside of the leg 72 of the pole piece 70.

The latch lever 24 also carries a flat, diagonal projection 100 closely adjacent to a post 102 which is generally parallel to the pivot 16. A second torsion spring, generally designated 104, is mounted on the post 102 and includes one end 106 affixed to the projection 100 to prevent rotation of the coil 108 of the torsion spring 104 about the post 102. The opposite end 110 of the torsion spring 104 acts as a reset finger and extends diagonally, at an acute angle past the end of the projection 100 in the direction of the push button actuator 26. In this connection, the shank 30 of the push button actuator 26 includes a notch 112 which acts as a stop surface and cooperates with the reset finger 110 for shifting the latch lever 24 to the position illustrated in FIG. 1.

Turning now to the push button actuator 26, the lower end of the same includes a ledge 114 against which a biasing spring 116 is abutted. The biasing spring 116 provides an upward bias to the push button 26 to bias the same to its uppermost position (not shown) within the opening 25.

The push button 28 of the operator 26, just above the shank 30, includes an outwardly extending tongue or ledge 120. At the same time, the housing 10 includes a first notch having a retaining surface 122 and a second notch having a detent surface 124. The retaining surface 122 is above and in front of the detent surface 124. As can be derived from FIG. 1, the ledge 120 may abut the retaining surface 122 to retain the manual operator 26 within the housing 10 or it may abut the detent surface 124 to hold the push button 28 in a depressed position against the bias of the spring 116 as shown.

Preferably, the operator 24 is made to be generally cylindrical except for the ledge 120 so as to be rotatable within the housing 10 as well as reciprocal therein. As a consequence, when the operator 26 is pushed downwardly to the position illustrated in FIG. 1, the same may be rotated to bring the ledge 120 into underlying relation with the detent surface 124. In this position, the operator is restrained in its lowermost position which corresponds to the automatic reset mode for the relay.

It is to be particularly observed from FIG. 1 that in the automatic reset mode, the ledge 120 abuts the upper end 90 of the latch finger 88. This holds the latch finger 88 out of engagement with the latch surface 84,86 and the latch arm 24.

As more fully described in my previously identified co-pending application, when the relay mechanism is tripped, the armature 18 and the latch lever 24 will pivot to the other of the stable positions, namely, that wherein the pole piece 64 is in contact with the underside of the leg 72 of the pole piece 70. In this case, the end 110 of the spring 108 will enter the notch 112 so that if the push button 28 is depressed, the spring end 110 will be moved towards a horizontal position, forcing the latch arm 24 to pivot the armature 18 in a counterclockwise direction to the reset position illustrated in FIG. 1. Just before that occurs, however, the ledge 120 will contact the upper end 90 of the latch arm 88 and depress the same to bring the same out of engagement with the latch surface 84,86 and release the latch lever 24 for such pivotal movement.

A particularly desirable feature of the invention is the provision of a means whereby the moveable contacts 20,22 are positively shifted as they close to cause a wiping action against their respective fixed contacts 12,14 to preclude any environmental grime from preventing good electrical contact upon closing. To this end, the slot 47 in both of the contact bars 42 has an end-to-end or first predetermined dimension, "D" as shown in FIG. 3. This dimension is measured in a plane that is parallel to, but spaced from the axis of rotation of the armature 18 defined by the pivot 16. Where the contact bars 42 are flat, it is the plane of the contact bar 42, it is measured in a direction parallel to the direction of elongation of the armature 18 or, in the specific embodiment illustrated, the direction of elongation of each of the contact bars 42.

In addition, the upper end of the post has a side-to-side or second predetermined dimension "d" measured in the same direction. The dimension "d" is that of the upper end of the post 44 measured above the surfaces 46 and is less than the dimension "D" of the slot 46.

As a consequence, the contact bar 42 may shift bi-directionally in the direction of an arrow 130 (FIG. 3) on the post 44. The contact bar 42 may also move toward or away from the pivot 16 on the upper end of the post 44. This direction of movement is shown by an arrow 132 in FIG. 2.

Figure 4:
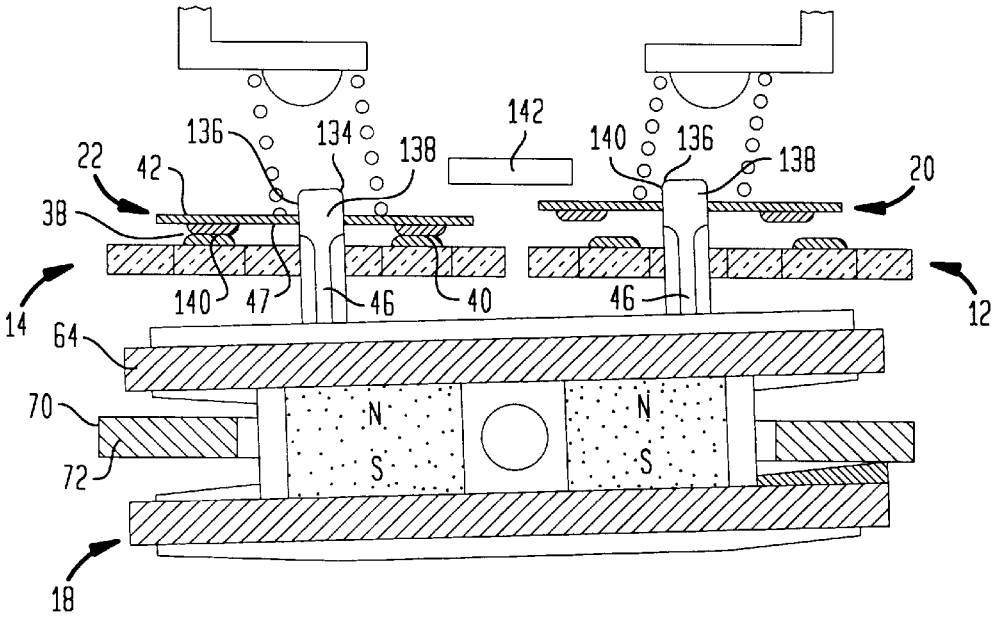
FIG. 4 is a view of the configuration of the components at an intermediate position of an armature between its two stable positions and illustrating the initiation of wiping movement by the contacts.

The dimensions "D" and "d" are such that one side 134 or 136 or the other of the post 44, depending upon the direction of movement of the latch lever 24 will abut a corresponding end 138,140 of the slot 47 to positively drive the contact bar 42 either to the right or to the left as viewed in FIGS. 1 and 4 during closing or opening action of either of the contact bars 42.

By way of example, and referring to the contacts 14,22, when the same are in an open condition, the side 134 of the post 44 will be against the end 138 of the slot 47 in the contact bar 42. As the latch lever 24 is moved in a counterclockwise direction, the contact bar 42 will remain generally in that position on the post 46 as a result of friction between the surfaces 46 and the contact bar 42. When the contacts 43 on the contact bar 42 make initial contact with the contact 38,40 defining the fixed contacts 14, they will be offset therefrom as shown in FIG. 4. That is to say the contacts 43 on the contact bar 42 will not be centered on corresponding ones of the contacts 38,40. The contact bar 42 will remain in this position as a result of friction through engagement with the contacts 38,40. At the same time, as can be seen in FIG. 4, the armature 18 has not moved fully to its reset position, that is, the pole piece 64 has not yet come in contact with the upper surface of the leg 72 of the pole piece 70.

As the armature 18 continues to move to that stable position where such contact is made and as is illustrated in FIG. 1, the post 44 will move within the slot 47 until its side 136 contacts the end 140 of the slot 47 in the contact bar 42. The dimensions "D" and "d" are chosen such that this will occur before the armature 18 has moved to the position illustrated in FIG. 1.

As the armature 18 continues to move to the position illustrated in FIG. 1, because the side 136 has now bottomed out or is in abutment with the slot end 140, it will drive the contact bar 42 to the left from the position shown in FIG. 4 to the position shown in FIG. 1 where the contacts 43 on the contact bar 42 are now centered on the contacts 38,40 as illustrated in FIG. 1. This shifting movement or wiping movement assures that the contacts 38,40,43 will scrape through any grime that may have accumulated thereon to achieve good electrical contact which is particularly advantageous for low power contact configurations. For high power applications, the dimensions "D" and "d" may be chosen to provide a lesser degree of wiping or even no wiping action at all.

At the same time, on the opposite side of the armature 18, the post 46 thereat will move from a position whereat the side 134 thereof is engaged with the end 138 of the slot to bring the side 136 of the post 46 into contact with the end 140 of the slot 47 in its associated contact bar 42 to set the stage for similar wiping action when the relay is tripped and the contacts 12,20 are closed. To assure such movement, the housing 10 may mount a stop 142 that is engaged by either of the contact bars 42 when moved to its open position. The stop 142 also provides a levelling function for the contact bar 42.

From the foregoing, it will be appreciated that a trip mechanism for an overload relay or a switching mechanism made according to the invention assures that contact bars employed in bridging contacts close against both contacts simultaneously. The same also provides a highly desirable, positive wiping action at the time of contact closure to assure that environmental grime does not interfere with the electrical circuit being made by the contacts.

Additional advantages and modifications will readily occur to those skilled in the art. Therefore, the invention in its broader aspect is not limited to the specific details, and representative devices, shown and described herein. Accordingly, various modifications may be made without departing from the spirit or scope of the general inventive concept as defined by the appended claims and their equivalents.

I claim:

1. A trip mechanism for an overload relay comprising:

a housing;

a bistable armature mounted in said housing on a pivot for pivotal movement between two stable positions;

fixed contacts within said housing;

moveable contacts within said housing;

at least one spring means within said housing engaging said moveable contacts and normally urging said moveable contacts toward said fixed contacts to establish an electrical conducting relation therebetween;

moveable contact engaging means on said armature and opposite of said spring means for engaging said moveable contacts and moving them away from said fixed contacts against the bias of said spring means for one of said two stable positions and for effectively disengaging said moveable contacts to allow said spring means move said moveable contacts into said electrical conducting relation for the other of said two stable positions;

a latch surface carried by one of said armature and said housing; and a spring mounted on the other of said armature and said housing and having a latch finger for engaging said latch surface and retaining said armature in one of said two positions.

2. The trip mechanism of claim 1, wherein said latch surface is provided on a latch arm carried by said armature.

3. The trip mechanism of claim 1, further including means for disabling said latch arm.

4. The trip mechanism of claim 2, wherein said disabling means comprises a manual operator.

5. The trip mechanism of claim 4, wherein said manual operator is a push button reciprocally mounted on said housing for movement toward and away from said latch arm.

6. The trip mechanism of claim 5, further including an additional spring carried by said latch arm and having a reset finger moveable into the path of reciprocal movement of said push button when said armature is in said one position, said push button further including a stop surface facing said reset finger and engaged thereby when said push button is reciprocated to cause said finger to push said latch arm and said armature to the other of said two positions.

7. The trip mechanism of claim 6, wherein said latch arm carries a post that is generally parallel to but spaced from said pivot and said additional spring is a torsion spring that includes a coil disposed on said post, said finger extending from said coil toward said push button at an acute angle toward the path of reciprocating movement of said push button.

8. The trip mechanism of claim 7, wherein said push button includes an elongated shank and said stop surface is a notch in said shank.

9. The trip mechanism of claim 1, wherein said armature is elongated and said moveable contact engaging means includes an elongated contact engaging post extending generally transverse to the direction of elongation of said armature, said moveable contact including an elongated contact bar generally parallel to said armature, a fulcrum on said post and a biasing spring carried by said housing for biasing said contact bar into engagement with said fulcrum.

10. The trip mechanism of claim 9 wherein said fulcrum is defined by two spaced surfaces on said post.

11. The trip mechanism of claim 1 wherein said moveable contacts are defined by an elongated contact bar and said fixed contacts are spaced from one another in the direction of elongation of said contact bar, a slot in said bar having a side-to-side first predetermined dimension in the direction of elongation of said contact bar, a post on said armature extending through said slot and having an end-to-end second predetermined dimension in the direction of elongation of said bar that is less than that of said slot so as to allow said contact bar to shift on the post in the direction of elongation of said contact bar, and a shoulder on said post engageable with said contact bar for locating said contact bar at a predetermined position on said post so that said contact bar will close against said fixed contacts before said armature reaches one of its two stable positions, said dimensions being sized so that said post will engage an end of said slot before said armature is moved to said one of said two stable locations at or after said contact bar closes against said fixed contacts, whereby as said armature moves to said one of said two stable positions and at or after said contact bar closes against said fixed contacts, said contact bar will be moved in the direction of its elongation to wipe said fixed contacts.

12. A switch for use in an electrical mechanism comprising:

an actuator mounted on a pivot for movement between two actuator positions;

a pair of spaced, fixed contacts;

a contact bar moveable between a closed position engaging and bridging said fixed contacts to electrically connect the same and an open position spaced from said fixed contacts;

a contact carrier on said actuator to be moveable therewith and having a contact mounting post with a side-to-side first predetermined dimension measured in a plane spaced from said pivot; and a slot in said contact bar loosely receiving said post to allow movement of said contact bars on said post in said transverse direction, said slot having an end-to-end second predetermined dimension in said transverse direction greater than said first dimension;

said post carrying said contact bar such that it will move to said closed, bridging position as said actuator moves from one of said two actuator positions and before said actuator reaches the other of said two actuator position at an intermediate actuator position;

said first and second dimensions being that said post will engage an end of said slot at or after said actuator reaches said intermediate position and before said actuator reaches said other actuator position;

whereby when said actuator moves from said one actuator position, said contact bar will move to said closed position and said post will then or thereafter engage said end of said slot to shift said contact bar relative to said fixed contacts while engaged therewith as said actuator moves from said intermediate actuator position to said other actuator position.

13. The switch of claim 12 wherein said contact bar is elongated in said transverse direction.

14. The switch of claim 12 wherein both said first and second dimensions are elongated in said transverse direction.

15. The switch of claim 12 wherein said post includes a shoulder and said contact bar is moveable on said post toward and away from said shoulder; and further including a spring biasing said contact bar toward said shoulder.

16. The switch of claim 12 incorporated in an overload relay and including a housing; said actuator being an armature pivotally mounted in said housing for movement between said two actuator positions; a latch surface carried by one of said armature and said housing; and a spring mounted on the other of said armature and said housing and having a latch finger for engaging said latch surface and retaining said armature in said another actuator position.

* * * * *